US009334454B2

(12) United States Patent
Zhong et al.

(10) Patent No.: US 9,334,454 B2
(45) Date of Patent: May 10, 2016

(54) METHOD FOR PRODUCING SYNTHESIS NATURAL GAS USING STRAW GAS

(75) Inventors: Yaling Zhong, Chengdu (CN); Yuming Zhong, Chengdu (CN); Qiming Zeng, Chengdu (CN); Yueming Cai, Chengdu (CN); Tianhong Chen, Chengdu (CN)

(73) Assignee: SICHUAN YALIAN TECHNOLOGY CO., TDL, Chengdu, Sichuan (CN)

( * ) Notice: Subject to any disclaimer, the term of this patent is extended or adjusted under 35 U.S.C. 154(b) by 448 days.

(21) Appl. No.: 14/114,643

(22) PCT Filed: Apr. 15, 2011

(86) PCT No.: PCT/CN2011/072837

§ 371 (c)(1),
(2), (4) Date: Oct. 29, 2013

(87) PCT Pub. No.: WO2012/058903

PCT Pub. Date: May 10, 2012

(65) Prior Publication Data

US 2015/0299595 A1 Oct. 22, 2015

(30) Foreign Application Priority Data

Nov. 5, 2010 (CN) ..... 2010 1 0533832

(51) Int. Cl.
*C10L 3/00* (2006.01)
*C10L 3/08* (2006.01)

(52) U.S. Cl.
CPC ..... *C10L 3/08* (2013.01); *C10L 2290/06* (2013.01); *C10L 2290/42* (2013.01); *C10L 2290/542* (2013.01)

(58) Field of Classification Search
CPC ..... C10G 2/00; C10G 2/30; C10G 2/32; C10G 2/33; C10G 2/331
See application file for complete search history.

(56) References Cited

U.S. PATENT DOCUMENTS 4,191,664 A * 3/1980 McArthur ..... B01J 23/755 502/335
5,089,034 A * 2/1992 Markovs ..... B01D 53/04 95/123
2008/0016769 A1* 1/2008 Pearson ..... C10J 3/466 48/197 R

* cited by examiner

*Primary Examiner* — Jafar Parsa
*Assistant Examiner* — Medhanit Bahta

(57) ABSTRACT

A method for producing synthesis natural gas using a straw gas, includes the steps of: pressurizing and heating a conventional straw gas, conveying the straw gas to a converter containing carbon monoxide and hydrogen to react therewith in the presence of nickel-based catalyst, so as to result in conversion gas mixture with main components of methane, carbon dioxide, water and impurity; and cooling, gas-liquid separating and purifying to obtain a synthesis natural gas with methane content of over 90%. The synthesis natural gas obtained according to the method of present invention has high energy utilization efficiency, and can not only be used for civilian by a conventional natural gas infrastructure, but also serve as an energy supply for a combustion engine or a small gas turbine.

13 Claims, 4 Drawing Sheets

METHOD FOR PRODUCING SYNTHESIS NATURAL GAS USING STRAW GAS

CROSS REFERENCE OF RELATED APPLICATION

This is a U.S. National Stage under 35 U.S.c 371 of the International Application PCT/CN2011/072837, filed Apr. 15, 2011, which claims priority under 35 U.S.C. 119(a-d) to CN 201010533832.1, filed Nov. 5, 2010.

BACKGROUND OF THE PRESENT INVENTION

1. Field of Invention

The present invention relates to a field of biomass energy, and more particularly to a method for producing synthesis natural gas using a straw gas.

2. Description of Related Arts

As more and more attentions are paid to renewable energy sources, the development and utilization technologies of renewable energy sources have been greatly improved. One of them is to obtain straw gas through gasifying straw after crushing for an application of fuel gas. This production technology for the straw gas is well known, the straw gas generated thereby is a kind of gas mixture which mainly contains carbon monoxide, carbon dioxide, hydrogen, and methane, wherein a content of methane thereof is usually no more than 20% and a calorific value thereof is just between 1000~2000 kcal/$Nm^3$, which belongs to a low calorific value fuel gas.

Currently, this kind of straw gas has already been used by people for cooking and warming, but efficiency of the energy utilization is low, and the straw resource can not be fully explored. It has been also reported that the straw gas replaces coal for generating electricity, but there are still some limitations due to the low calorific value thereof. The low content of methane seriously restricts the application range of the straw gas, so that it is hard to fully use the huge straw resource.

SUMMARY OF THE PRESENT INVENTION

An object of the present invention is to provide a method for producing synthesis natural gas using a straw gas, wherein the synthesis natural gas generated according to this method can be a substitute of a natural gas to increase the energy utilization efficiency of straw sources.

Accordingly, in order to accomplish the above object, technical solutions provided by the present invention are as follows.

A method for producing synthesis natural gas using a straw gas, is comprised of the steps of:

(a) pressurizing, wherein the straw gas is conveyed to a compressor and pressurized to 1.0~2.0 Mpa;

(b) heating, wherein the straw gas pressurized in step (a) is conveyed to a pre-heater and heated to 300~320° C.;

(c) synthesizing methane, wherein the straw gas obtained in step (b) is conveyed to a converter containing carbon monoxide and hydrogen to react therewith in the presence of nickel-based catalyst, so as to result in conversion gas mixture with main components of methane, carbon dioxide, water and impurities;

(d) cooling, wherein the converted gases mixture resulted in steps (c) is conveyed to a condenser for cooling to 20~40° C., so as to result in cooled conversion gas mixture;

(e) gas-liquid separating, wherein the cooled conversion gas mixture resulted in the step (d) is conveyed to a gas-liquid separator, so as to result in gas-liquid separated gases mixture; and (f) purifying, wherein the gas-liquid separated gases mixture processed by the gas-liquid separator in the step (e) are conveyed to an adsorption purifier for removing carbon dioxide, water, nitrogen, oxygen, carbon monoxide and impurities to obtain the synthesis natural gas with methane content of over 90%, wherein the "with methane content of over 90%" here means that the volume of methane accounts for 90%~100% of the volume of the synthesis natural gas.

The straw gas is a fuel gas resulted from vaporization of straw. Similar gas sources used for producing the synthesis natural gas comprise coal-based syngas, coke oven gas and natural gas syngas, which all belong to non-renewable fossil energy. However, the straw is renewable and unclean biomass energy, and it is of great significance to convert a renewable and unclean energy into a clean energy by the technology according to the present invention.

In the technical solution mentioned above, the components of the nickel-based catalyst and mass percentages thereof comprise: 60~80% of $Al_2O_3$, 0~10% of $TiO_2$, 10~30% of NiO, 0~10% of $La_2O_3$, and 0~30% of carbon nano-tubes (CNTs), wherein NiO is an active component, $\gamma$-$Al_2O_3$ and $TiO_2$ are carriers, $La_2O_3$ and CNTs are co-catalysts. The nickel-based catalyst are screened creatively by adding the CNTs which are constituted by a graphitization wall, a nano-scale tubes' cavity and a sp2-C, so as to promote the adsorption and activation of hydrogen and promote excellent properties of hydrogen overflow, in such a manner that the nickel-based catalyst has a superior performance of carbon deposition resistance when the volume ratio of $H_2/(CO+CO_2)<1$.

A converted gas pipeline extended from the converter connects with the pre-heater at first, and then goes through the condenser to connect with an inlet of the gas-liquid separator, in such a manner that the pre-heater is capable of recycling and reusing heats in the converter.

The straw gas pressurized by the compressor is directly conveyed to the converter in step (c) through a straw gas pipeline provided in the pre-heater; the conversion gas mixture outputted by the converter is conveyed to the gas-liquid separator through a converted gas pipeline provided in the condenser; the gas-liquid separated gases mixture which is separated by the gas-liquid separator are conveyed to the adsorption purifier in step through two converted gas pipelines to be processed thereby; so as to result in the synthesis natural gas with methane content of over 90%.

Another method for producing a synthesis natural gas using a straw gas, is comprised of the steps of:

(a) pressurizing, wherein the straw gas is conveyed to a compressor and pressurized to 1.0~2.0 Mpa;

(b) purifying, wherein the straw gas pressurized in step (a) is conveyed to an adsorption purifier to be purified therein;

(c) heating, wherein the straw gas purified in step (b) is conveyed to a pre-heater to be heated thereby to 300~320° C.;

(d) synthesizing methane, wherein the straw gas heated in step (c) is conveyed to a converter, so as to be reacted therein in the presence of nickel-based catalyst;

(e) cooling, wherein conversion gas mixture resulted in step (c) is conveyed to a condenser to be cooled thereby to 20~40° C., so as to result in cooled conversion gas mixture; and (f) gas-liquid separating, wherein the cooled conversion gas mixture is conveyed to a gas-liquid separator to be processed thereby, so as to result in the natural gas with methane content of over 90%.

In the technical solution mentioned above, the straw gas pressurized by the compressor in step (a) is conveyed to an adsorption purifier through a straw gas pipeline at first, and then is conveyed to a converter through a purified gas pipeline provided in the pre-heater in the step (c); and conversion gas mixture outputted by the converter in step (d) are conveyed to the gas-liquid separator in step (f) through a converted gas pipeline provided in the condenser in the step (e), and are processed by the gas-liquid separator in the step (f), so as to result in the natural gas with methane content of over 90%.

The components of the nickel-based catalyst and mass percentages thereof comprise: 60~80% of $Al_2O_3$, 0~10% of $TiO_2$, 10~30% of NiO, 0~10% of $La_2O_3$, and 0~30% of CNTs.

The converted gas pipeline extended from the converter firstly connects with the pre-heater, and then goes through the condenser to connect with an inlet of the gas-liquid separator.

Compared with the conventional process, the present invention has the advantages comprising:

(1) high content of methane and high calorific value, wherein the content of methane of the straw gas is conventionally not exceeding 20% and the calorific value is just between 1000~2000 Kcal/$Nm^3$, but the content of methane of the synthesis natural gas resulted from the method of the present invention is over 90% and the calorific value can be increased to a value greater than or equal to 8000 Kcal/$Nm^3$.

(2) complete utilization of straw resource which improves the energy utilization efficiency, wherein the calorific value of the conventional straw gas is low and the energy utilization thereof is not high; the energy utilization efficiency of the synthesis natural gas obtained according to the present invention is improved, which not only can be used by a conventional natural gas infrastructure for civilian, but also can serve as an energy supply for a combustion engine or a small gas turbine.

(3) a great amount of steam by-produced by the converter, wherein the steam by-produced by the converter can be effectively used according to the scale of production, wherein the steam can be used for heating or warming in a small-scale production (less than 1000 $Nm^3$/h); and the steam can be used for a generator or a steam turbine in a large-scale production (more than 5000 $Nm^3$/h) to decrease energy consumption.

(4) small amount of equipment, high utilization efficiency and low energy consumption, wherein in the present invention, the straw gas before reaction is heated by the high-temperature conversion gas mixtures synthesized by the converter to recycle a heat energy, in such a manner that a synthesis reaction can be processed under a low pressure.

DETAILED DESCRIPTION OF THE PREFERRED EMBODIMENT

Figure 1:
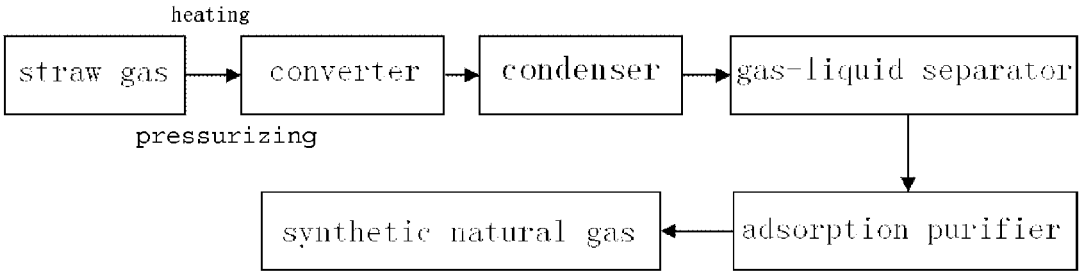
FIG. 1 is a Process Flow Block Diagram according to a second preferred embodiment of the present invention.

The objectives, features, and advantages of the present invention will become apparent from the following detailed description, the attached drawings, and the appended claims.

One skilled in the art will understand that the embodiment of the present invention as shown in the drawings and described above is exemplary only and not intended to be limiting.

Embodiment 1

A method for producing synthesis natural gas using a straw gas, is comprised of the steps of:

(1) pressurizing a conventional straw gas with components (V %) comprising 15.08% of CO, 30.97% of $CO_2$, 26.32% of $H_2$, 16.41% of $CH_4$, 0.91% of $O_2$, 5.67% of $N_2$, 0.28% of $C_xH_y$ to 2.0 Mpa by a compressor and then conveying to a pre-heater to be heated to 319.3° C.;

(2) conveying the straw gas under temperature and pressure conditions mentioned above to a converter, wherein CO reacts with $H_2$ in the presence of nickel-based catalyst, and reaction thereof is methanation reaction, wherein one CO reacts with three $H_2$ to generate one methane (gas) and one water (steam), components of an outlet gas of the converter comprises: 7.65% of CO, 37.97% of $CO_2$, 0% of $H_2$, 30.54% of $CH_4$, 1.10% of $O_2$, 6.88% of $N_2$, 0.34% of $C_xH_y$, wherein a pressure at this moment is 1.89 Mpa, and the temperature is 527.3° C.; wherein the components and mass percentages of the nickel-based catalyst comprise: 70% of $Al_2O_3$, 1% of $TiO_2$, 15% of NiO, 9% of $La_2O_3$, 5% of CNT, the mass percentages of the components of the nickel-based catalyst can be adjusted according to actual condition, e.g., the mass percentages of $Al_2O_3$ can be selected from 61%, 69%, 75%, and 80% or other values between 60 to 80%, the mass percentages of $TiO_2$ can be selected from 1%, 3%, 5% and 8% or other values between 0~10% (without 0), the mass percentages of NiO can be selected from 10%, 16%, 22% and 28% or other values between 10~30%, the mass percentages of $La_2O_3$ can be selected from 0.8%, 5%, 7% and 10% or other values between 0~10% (without 0), the mass percentages of CNTs can be selected from 5%, 9%, 18%, 22% and 29% or other values between 0~30% (without 0);

(3) cooling the high-temperature conversion gas mixture outputted by the step (2) to 20~40° C. to condense most vapor water into liquid water, wherein then the liquid water is separated by the gas-liquid separator to obtain conversion gas mixture at room temperature and containing a small amount of saturated water;

(4) conveying the conversion gas mixture at ambient temperature to the adsorption purifier, wherein the adsorption purifier comprises a plurality of adsorptive equipment containing different adsorbents according to the first preferred embodiment, by using different adsorption capacities of the adsorbents on the two different material under different pressures, a large amounts of carbon dioxide and a small amount of impurities such as water, nitrogen, oxygen and carbon monoxide in the conversion gas mixture is removed, the components of a product outputted from the adsorptive equipment and mass percentages thereof comprises: 0.89% of $CO_2$, 91.37% of $CH_4$, 4.70% of $N_2$ and 1.11% of $C_xH_y$, wherein the pressure at this moment is 1.80 Mpa, the temperature is 32.5° C.; the product then meets Chinese national gas standards of country and town and the synthesis natural gas with methane volume content of over 90% is obtained.

Embodiment 2

Figure 2:
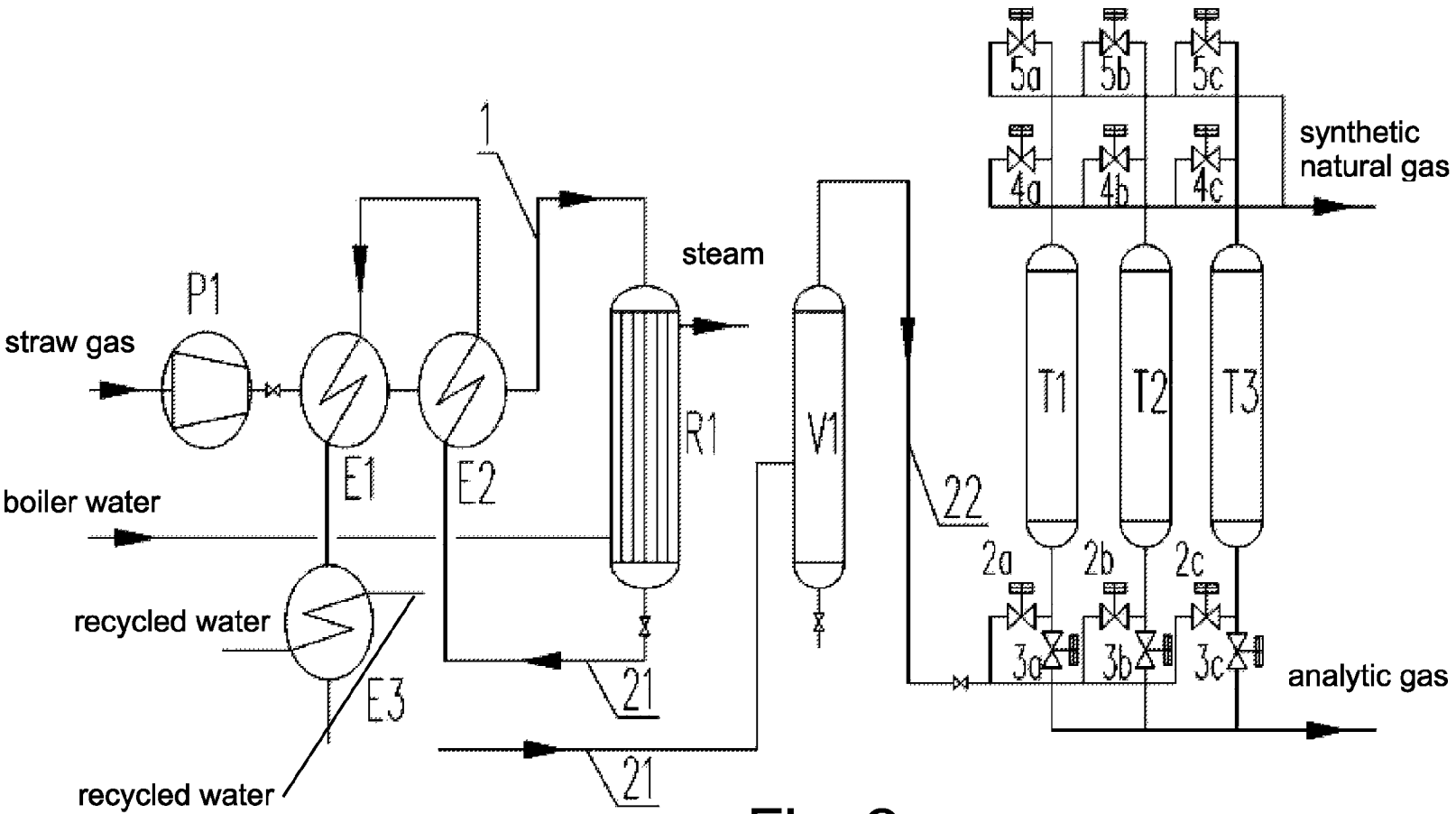
FIG. 2 is a Process Flow Diagram according to the second preferred embodiment of the present invention.

Referring to FIG. 1 and FIG. 2 of the drawings, a method for producing the synthesis natural gas using the straw gas according to this preferred embodiment, the straw gas pressurized by the compressor P1 is directly conveyed to the converter R1 through a straw gas pipeline 1 provided in the pre-heaters E1 and E2; the conversion gas mixture outputted by the converter R1 is conveyed to the gas-liquid separator V1 through a converted gas pipeline 21 provided in the condenser E3; the gas-liquid separated gas mixture which is separated by the gas-liquid separator V1 are conveyed to the adsorption purifier through two converted gas pipelines 22 to be processed thereby; so as to result in the synthesis natural gas with methane content of over 90%.

When producing the synthesis natural gas, a conventional straw gas with the components (V %) comprising: 15.08% of CO, 30.97% of $CO_2$, 26.32% of $H_2$, 16.41% of $CH_4$, 0.91% of $O_2$, 5.67% of $N_2$, 0.28% of $C_xH_y$ is injected through the compressor P1, the pressure applied in the compressor is set to 1.5 Mpa. The straw gas which has been pressurized is outputted from an outlet of the compressor P1 and enters the converter R1 through the straw gas pipeline 1. The straw gas pipeline 1 is provided in the pre-heaters E1, E2, so when the straw gas goes through the straw gas pipeline 1, the straw gas is heated by the pre-heaters E1, E2, the temperature of the straw gas which has been heated is set to 323.7° C. The straw gas which has been pressurized and heated enters the converter R1, wherein carbon monoxide and hydrogen of the straw gas are synthesized to a methane gas which has high calorific value. The converter R1 comprises a nickel-based catalyst, and the components of the nickel-based catalyst and mass percentages thereof comprise: 60~80% of $Al_2O_3$, 0-10% of $TiO_2$, 10~30% of NiO, 0~10%, of $La_2O_3$, 0~30% of CNTs. Wherein NiO is an active component, $\gamma$-$Al_2O_3$ and $TiO_2$ are carriers, $La_2O_3$ and CNTs are co-catalysts, wherein the nickel-based catalyst are screened creatively through adding the CNT which has a graphitization wall, a nano-scale tubes's cavity, a sp2-C to promote an adsorption and activation of hydrogen and to promote excellent properties of hydrogen overflow in such a manner that the nickel-based catalyst has a superior performance of carbon deposition resistance when the volume ratio of $H_2/(CO+CO_2)<1$.

Methanation reaction occurs between CO and $H_2$ in the presence of nickel-based catalyst, wherein one CO reacts with three $H_2$ to generate one methane (gas) and one water (steam), so as to improve methane content of the gas mixture. Components of the conversion gas mixture outputted by the outlet of the converter R1 comprise: 7.89% of CO, 38.24% of $CO_2$, 0% of $H_2$, 29.74% of $CH_4$, 1.17% of $O_2$, 7.02% of $N_2$, 0.38% of $C_xH_y$, wherein a pressure at this moment is 1.4 Mpa, and the temperature is 521.7° C.;

The conversion gas mixture outputted by the converter R1 enters the gas-liquid separator V1 through the converted gas pipeline 21, wherein a part of the converted gas pipeline 21 is provided in a condenser E3, high-temperature conversion gas mixture outputted by the converter R1 is cooled to 20~40° C. by the pre-heaters E1, E2 and the condenser E3 when pass through the converted gas pipeline 21.

A converted gas pipeline 21 extended from the converter R1 firstly connects with the pre-heaters E1, E2, and then goes through the condenser E3 to connect with an inlet of the gas-liquid separator V1 in such a manner that the pre-heater E1 and E2 are capable of recycling and reusing a heat in the converter R1.

The cooled conversion gas mixture is injected into the gas-liquid separator V1, and then the cooled conversion gas mixture is separated by the gas-liquid separator V1 to obtain a gas mixture containing a small amount of saturated water; wherein the gas-liquid separated gases mixture enters the adsorption purifier through two converted gas pipelines 2;

In this embodiment, the adsorption purifier comprises three adsorbers T1, T2 and T3 and programmable control valves thereof including 2*a*, 2*b*, 2*c*, 3*a*, 3*b*, 3*c*, 4*a*, 4*b*, 4*c*, 5*a*, 5*b* and 5*c*. The adsorption purifier and the programmable control valves can use available equipments, by using different adsorption capacities of the adsorbents on two different materials under different pressures, a large amounts of carbon dioxide and a small amount of impurities such as water, nitrogen, oxygen and carbon monoxide in the conversion gas mixture are removed, wherein the components of a product outputted from the adsorber and mass percentages thereof comprises: 1.21% of $CO_2$, 90.07% of $CH_4$, 7.77% of $N_2$ and 0.95% of $C_xH_y$, wherein the pressure at this moment is 1.30 Mpa, and the temperature is 30.4° C.; the product then meets Chinese national gas standards of country and town to obtain synthesis natural gas with methane volume content of over 90%.

Embodiment 3

Figure 3:
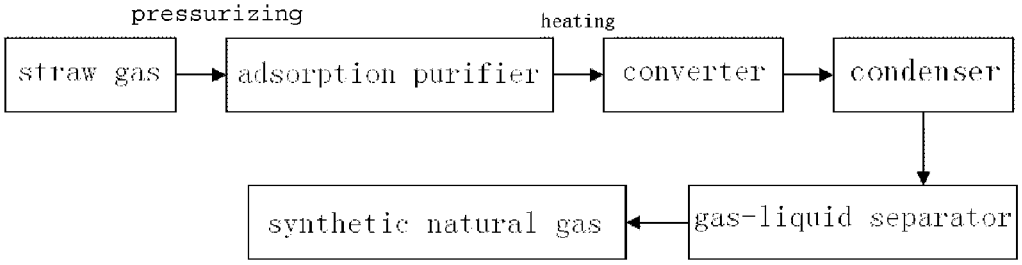
FIG. 3 is a Process Flow Block Diagram according to a third preferred embodiment of the present invention.
Figure 4:
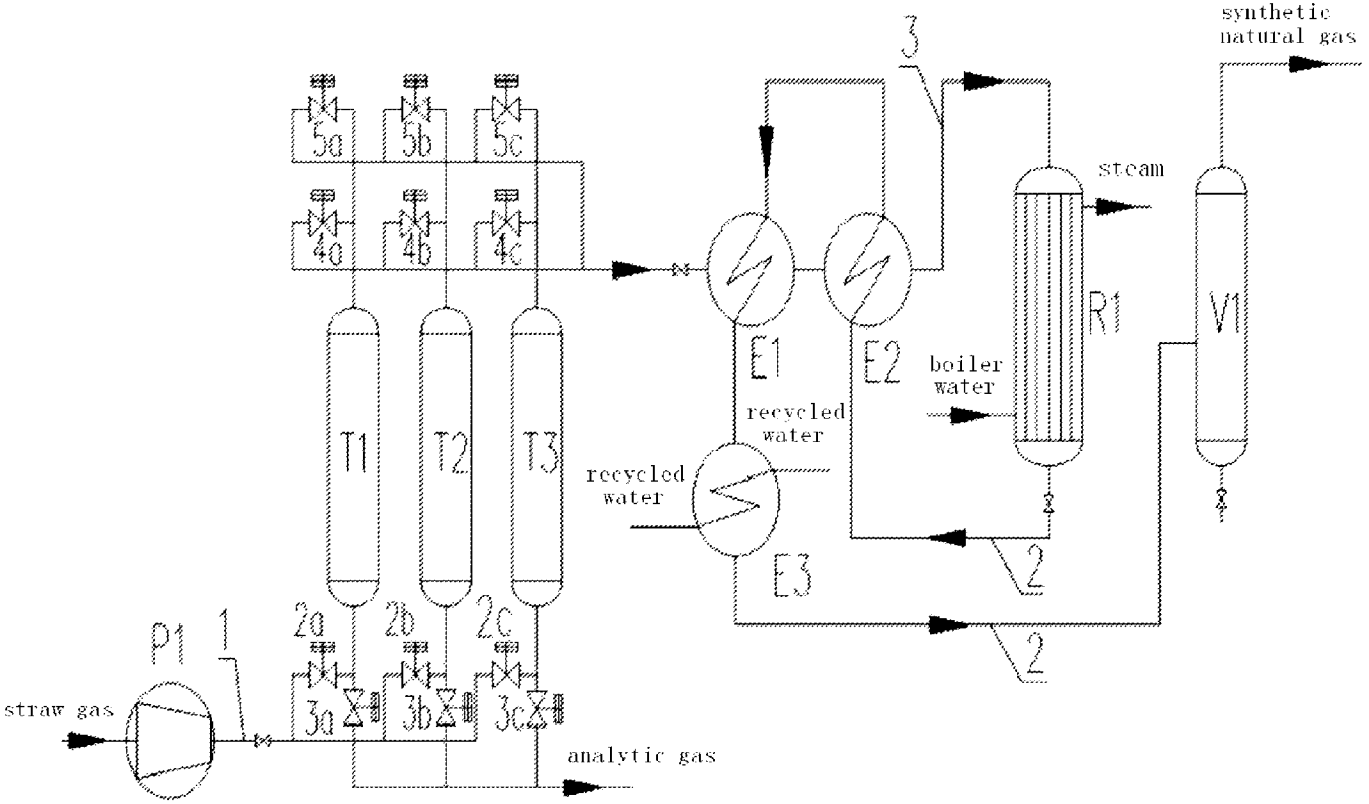
FIG. 4 is a Process Flow Diagram according to the third preferred embodiment of the present invention.

Referring to FIG. 3 and FIG. 4, a flow in this preferred embodiment is almost the same as thereof the second preferred embodiment, the difference only lies in that the step of purifying is occurred before the step of synthetizing methane by a converter.

A conventional straw gas with the components (V %) comprising 18.24% of CO, 29.05% of $CO_2$, 23.71% of $H_2$, 18.41% of $CH_4$, 0.45% of $O_2$, 5.32% of $N_2$, 0.30% of $C_xH_y$ is pressurized to 2.0 Mpa by the compressor P1.

The straw gas which has been pressurized enters an adsorption purifier through the straw gas pipeline 1, and a purified gas mainly containing three components of carbon monoxide, hydrogen, and methane is obtained after removing carbon dioxide and a small amount of nitrogen. The adsorption purifier comprises three adsorptive equipments T1, T2 and T3 and programmable control valves 2*a*, 2*b*, 2*c*, 3*a*, 3*b*, 3*c*, 4*a*, 4*b*, 4*c*, 5*a*, 5*b* and 5*c*.

The components of the purified gas which has been treated by the adsorption purifier, comprise: 24.87% of CO, 1.41% of $CO_2$, 35.20% of $H_2$, 27.43% of $CH_4$, 6.8% of $N_2$, wherein the purified gas is conveyed to the converter R1 through the purified gas pipeline 3; the purified gas pipeline 3 is provided in the pre-heaters E1, E2; so when the straw gas passes through the purified gas pipeline 3, the straw gas is heated by the pre-heaters E1, E2, and the temperature of the straw gas which has been heated is set to 317.79° C.

The mixture outputted by the converter R1 enters a gas-liquid separator V1 through a converted gas pipeline 21, wherein the converted gas pipeline 21 is provided in the condenser E3, the high-temperature conversion gas mixture is cooled when passes through a converted gas pipeline 21; then the straw gas containing 21.19% of CO, 2.28% of $CO_2$, 63.41% of $CH_4$, 10.99% of $N_2$ is obtained by the gas-liquid separator V1, the calorific value of the straw gas at this time is over 6000 Kcal/$Nm^3$ for civil use, the efficiency thereof is higher than the conventional straw gas, and the straw gas is easy to use. The synthesis natural gas with methane volume content of over 90% is obtained after a treatment of the adsorption purifier. The product then meets Chinese national gas standards of country and town to obtain the synthesis natural gas with methane volume content of over 90%.

The converted gas pipeline 21 extended from the converter R1 firstly connects with the pre-heaters E1, E2, and then goes through the condenser E3 to connect with an inlet of the gas-liquid separator V1 in such a manner that the pre-heater is capable of recycling and reusing heats in the converter.

Among the above preferred embodiments of the present invention, the sum of the straw gas and the product or the purified gas treated by adsorption purifier is less than 100% which is because the component of water vapor in the straw gas is not involved in a calculation.

Furthermore, it is illustrated that the nickel-based catalyst has a superior performance of carbon deposition resistance through the result of the catalytic reaction using the nickel-based catalyst according to the preferred embodiment 1, 2 and 3, especially in the straw gas (which has high hydrocarbon ratio) methane reaction; a hydro-conversion rate is high, no hydrogen is detected at the outlet of the converter when the converter has good effect for controlling temperature control; the catalyst has high selectivity on the methane, which can be seen from the components of product obtained according to the preferred embodiments, and the selectivity of the methane is more than 99.5%.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for producing a synthesis natural gas using a straw gas, comprising the steps of:

(a) pressurizing, wherein the straw gas is conveyed to a compressor and pressurized to 1.0-2.0 Mpa, wherein components (V %) of the straw gas comprises 15.08% of CO, 30.97% of $CO_2$, 26.32% of $H_2$, 16.41% of $CH_4$, 0.91% of $O_2$, 5.67% of $N_2$, 0.28% of $C_xH_y$, and the compressor is pressurized to 2.0 Mpa, wherein in the formula $C_xH_y$, both x and y are natural numbers;

(b) heating, wherein the straw gas pressurized in step (a) is conveyed to a pre-heater and heated to 300-320° C.;

(c) synthesizing methane, wherein the straw gas obtained in step (b) is conveyed to a converter containing carbon monoxide and hydrogen to react therewith in the presence of nickel-based catalyst, so as to result in conversion gas mixture with main components of methane, carbon dioxide, water and impurities;

(d) cooling, wherein the converted gas mixture resulted in step (c) is conveyed to a condenser for cooling to 20-40° C., so as to result in cooled conversion gas mixture;

(e) gas-liquid separating, wherein the cooled conversion gas mixture resulted in the step (d) is conveyed to a gas-liquid separator, so as to result in gas-liquid separated gases mixture; and (f) purifying, wherein the gas-liquid separated gases mixture processed by the gas-liquid separator in the step (e) is conveyed to an adsorption purifier for removing carbon dioxide, water, nitrogen, oxygen, carbon monoxide and impurities to obtain the synthesis natural gas with methane content of over 90%.

2. The method for producing the synthesis natural gas using the straw gas, as recited in claim 1, wherein components of the nickel-based catalyst and mass percentages thereof comprise: 60-80% of $Al_2O_3$, 0-10% of $TiO_2$, 10-30% of NiO, 0-10% of $La_2O_3$, and 0-30% of carbon nano-tubes (CNTs).

3. The method for producing the synthesis natural gas using the straw gas, as recited in claim 2, wherein in the step (a), components (V %) of the straw gas comprises 15.08% of CO, 30.97% of $CO_2$, 26.32% of $H_2$, 16.41% of $CH_4$, 0.91% of $O_2$, 5.67% of $N_2$, 0.28% of $C_xH_y$, and the compressor is pressurized to 2.0 Mpa.

4. The method for producing the synthesis natural gas using the straw gas, as recited in claim 2, wherein in the step (b), the straw gas is heated to 319.3° C.

5. The method for producing the synthesis natural gas using the straw gas, as recited in claim 2, wherein components and mass percentages of the nickel-based catalyst comprise: 70% of $Al_2O_3$, 1% of $TiO_2$, 15% of NiO, 9% of $La_2O_3$, 5% of CNT, wherein the nickel-based catalyst is screened creatively through adding the CNT which has a graphitization wall, a nano-scale tubes's cavity, a sp2-C to promote an adsorption and activation of hydrogen and to promote excellent properties of hydrogen overflow in such a manner that the nickel-based catalyst has a superior performance of carbon deposition resistance when the volume ratio of $H_2/(CO+CO_2)<1$.

6. The method for producing the synthesis natural gas using the straw gas, as recited in claim 1, wherein the straw gas pressurized by the compressor in step (a) is directly conveyed to the converter in step (c) through a straw gas pipeline provided in the pre-heater in step (b); the conversion gas mixture outputted by the converter in step (c) is conveyed to the gas-liquid separator in step (e) through a converted gas pipeline provided in the condenser in step (d); the gas-liquid separated gases mixture in step (e) which is separated by the gas-liquid separator are conveyed to the adsorption purifier in step (f) through two converted gas pipelines to be processed thereby; so as to result in the synthesis natural gas with methane content of over 90%.

7. The method for producing the synthesis natural gas using the straw gas, as recited in claim 6, wherein the converted gas pipeline extended from the converter firstly connects with the pre-heater, and then goes through the condenser to connect with an inlet of the gas-liquid separator.

8. The method for producing the synthesis natural gas using the straw gas, as recited in claim 1, wherein in the step (b), the straw gas is heated to 319.3° C.

9. The method for producing the synthesis natural gas using the straw gas, as recited in claim 1, wherein components and mass percentages of the nickel-based catalyst comprise: 70% of $Al_2O_3$, 1% of $TiO_2$, 15% of NiO, 9% of $La_2O_3$, 5% of CNT, wherein the nickel-based catalyst is screened creatively through adding the CNT which has a graphitization wall, a nano-scale tubes's cavity, a sp2-C to promote an adsorption and activation of hydrogen and to promote excellent properties of hydrogen overflow in such a manner that the nickel-based catalyst has a superior performance of carbon deposition resistance when the volume ratio of $H_2/(CO+CO_2)<1$.

10. A method for producing a synthesis natural gas using a straw gas, comprising the steps of:

(a) pressurizing, wherein the straw gas is conveyed to a compressor and pressurized to 1.0-2.0 Mpa, wherein components (V %) of the straw gas comprises 15.08% of CO, 30.97% of $CO_2$, 26.32% of $H_2$, 16.41% of $CH_4$, 0.91% of $O_2$, 5.67% of $N_2$, 0.28% of $C_xH_y$, and the compressor is pressurized to 2.0 Mpa, wherein in the formula $C_xH_y$, both x and y are natural numbers;

(b) purifying, wherein the straw gas pressurized in step (a) is conveyed to an adsorption purifier to be purified therein;

(c) heating, wherein the straw gas purified in step (b) is conveyed to a pre-heater to be heated thereby to 300-320° C.;

(d) synthesizing methane, wherein the straw gas heated in step (c) is conveyed to a converter, so as to be reacted therein in the presence of nickel-based catalyst;

(e) cooling, wherein conversion gas mixture resulted in step (c) is conveyed to a condenser to be cooled thereby to 20-40° C., so as to result in cooled conversion gas mixture; and (f) gas-liquid separating, wherein the cooled conversion gas mixture is conveyed to a gas-liquid separator to be processed thereby, so as to result in the natural gas with methane content of over 90%.

11. The method for producing the synthesis natural gas using the straw gas, as recited in claim 10, wherein:

the straw gas pressurized by the compressor in step (a) is conveyed to an adsorption purifier through a straw gas pipeline at first, and then is conveyed to a converter through a purified gas pipeline provided in the pre-heater in the step (c); and the conversion gas mixture outputted by the converter in step (d) is conveyed to the gas-liquid separator in step (f) through a converted gas pipeline provided in the condenser in the step (e), and is processed by the gas-liquid separator in the step (f), so as to result in the natural gas with methane content of over 90%.

12. The method for producing the synthesis natural gas using the straw gas, as recited in claim 10, wherein the components of the nickel-based catalyst and mass percentages thereof comprise: 60-80% of $Al_2O_3$, 0-10% of $TiO_2$, 10-30% of NiO, 0-10% of $La_2O_3$, and 0-30% of CNTs.

13. The method for producing the synthesis natural gas using the straw gas, as recited in claim 10, wherein the converted gas pipeline extended from the converter firstly connects with the pre-heater, and then goes through the condenser to connect with an inlet of the gas-liquid separator.

* * * * *